United States Patent [19]

Koivula

[11] Patent Number: 4,586,411

[45] Date of Patent: May 6, 1986

[54] DEVICE FOR MANUFACTURING OF HEMMED PIECES OF CLOTH CUT FROM A WEB

[75] Inventor: Caj Koivula, Borås, Sweden

[73] Assignee: Akab of Sweden AB, Borås, Sweden

[21] Appl. No.: 636,262

[22] Filed: Jul. 31, 1984

[30] Foreign Application Priority Data

Aug. 3, 1983 [SE] Sweden ..... 8304244

[51] Int. Cl.[4] ..... D06H 7/02; B26D 7/14

[52] U.S. Cl. ..... 83/175; 83/18; 83/155; 26/51.3; 26/51.4; 26/51.5

[58] Field of Search ..... 83/175, 18, 155; 26/51.4, 51.3, 51.5; 112/141, 304

[56] References Cited

U.S. PATENT DOCUMENTS 4,187,132 2/1980 Dijk et al. ..... 26/51.4

*Primary Examiner*—Donald R. Schran

*Attorney, Agent, or Firm*—Holman & Stern

[57] ABSTRACT

A device for manufacture of pieces of cloth cut from a web e.g. a mesh tissue web or the like in the direction of the threads, and having the cut edges trimmed e.g. hemmed, and of the type where the web prior to the cutting is straigthened in pile-free positions by means of a straightening device. The object of the present invention is to provide a device with which a straightening, cutting and then a trimming of the cut edges are effected on a simple way, without the piece of cloth thereby having any possibility of becoming deformed. Another object of the invention is to provide a compact device which does not demand larger place than the known straightening devices. Furthermore according to the invention it shall also be possible to treat web which are equipped with longitudinal side seams with the device. These tasks have been solved by the fact that the straightening device consists of two rulers extending laterally across the web and being adjustable relative to each other, thus that the web or only pile-free portions thereof can pass freely between them, that in front of the straightening device as seen in the web direction is arranged a transfer device adapted to pass through a first conveyor device and equipped with seizing means for conveying the forward edge of the web for advancing and metering a piece of cloth and for transfer of its forward edge to a second conveyor device, and that the first and second conveyor devices are provided with means for arresting the cut edges of each piece of cloth and for transport of the piece of cloth in arrested position to a device for trimming the cut edges.

5 Claims, 8 Drawing Figures

DEVICE FOR MANUFACTURING OF HEMMED PIECES OF CLOTH CUT FROM A WEB

The present application relates to a device for manufacture of pieces of cloth cut from a web e.g. a mesh tissue web or the like in the direction of the threads, and having the cut edges trimmed e.g. hemmed, and of the type where the web prior to the cutting is straightened in pile-free positions by means of a straightening device.

BACKGROUND OF THE INVENTION

For cutting off pieces of cloth in the direction of the threads from a mesh tissue web, older constructions which utilize the pile-free sections of the mesh tissue web, have been used for straightening the cloth. On a known device (U.S. Pat. No. 3,182,536) the straightening takes place against a holder ledge which is lowered into a gap in the pile of the bottom fabric at the same time as an advancing device subjects the web to traction, whereby the front edge of the pile sections following after the gap will engage the holder ledge and a straightening of the web is obtained. After the straightening of the web the advanced and straightened piece of cloth is cut off within the pile-free section, whereupon an edge trimming or hemming resp. of the cut edges of the piece of cloth is made in a separate machine. By the severing of the piece of cloth the free end of the web must be advanced until the driving rollers of the advancing device or a conveyor track cooperating therewith can take over the further advancement. At this transfer of the front edge of the web from the cutting device to the feeding device there often occur problems which make the feeding very unsecure. It is furthermore required a separate device for tooth fixing of the cut edges of the piece of cloth, which means that the pieces of cloth must be re-straightened in relation to the sewing machines and if the piece of cloth partly resumes its earlier deformed oblique-angled shape it is not possible to effect a perfect edge fixing.

There are also known devices, where the front edge of the web is clamped in a contraction device (Swedish patent publication No. 7609636-1) until a straightening device which is moveable in the feeding direction of the web takes over the feeding. Also this device requires that a separate device for edge fixing of the cut edges of the separate pieces of cloth is connected and a common step is that the single pieces of cloth after the straightening are piled on each other, in order later on to be transported to a sewing machine for edge trimming of the cut edges.

THE PURPOSE AND MOST IMPORTANT FEATURES OF THE INVENTION

The object of the present invention is to provide a device with which a straightening, cutting and then a trimming of the cut edges are effected on a simple way, without the piece of cloth thereby having any possibility of becoming deformed. Another object of the invention is to provide a compact device which does not demand larger place than the known straightening devices. Furthermore according to the invention it shall also be possible to treat web which are equipped with longitudinal side seams with the device. These tasks have been solved by the fact that the straightening device consists of two rulers extending laterally across the web and being adjustable relative to each other, thus that the web or only pile-free portions thereof can pass freely between them, that in front of the straightening device as seen in the web direction is arranged a transfer device adapted to pass through a first conveyor device and equipped with seizing means for conveying the forward edge of the web for advancing and metering a piece of cloth and for transfer of its forward edge to a second conveyor device, and that the first and second conveyor devices are provided with means for arresting the cut edges of each piece of cloth and for transport of the piece of cloth in arrested position to a device for trimming the cut edges.

DESCRIPTION OF THE EMBODIMENTS

Figure 1:
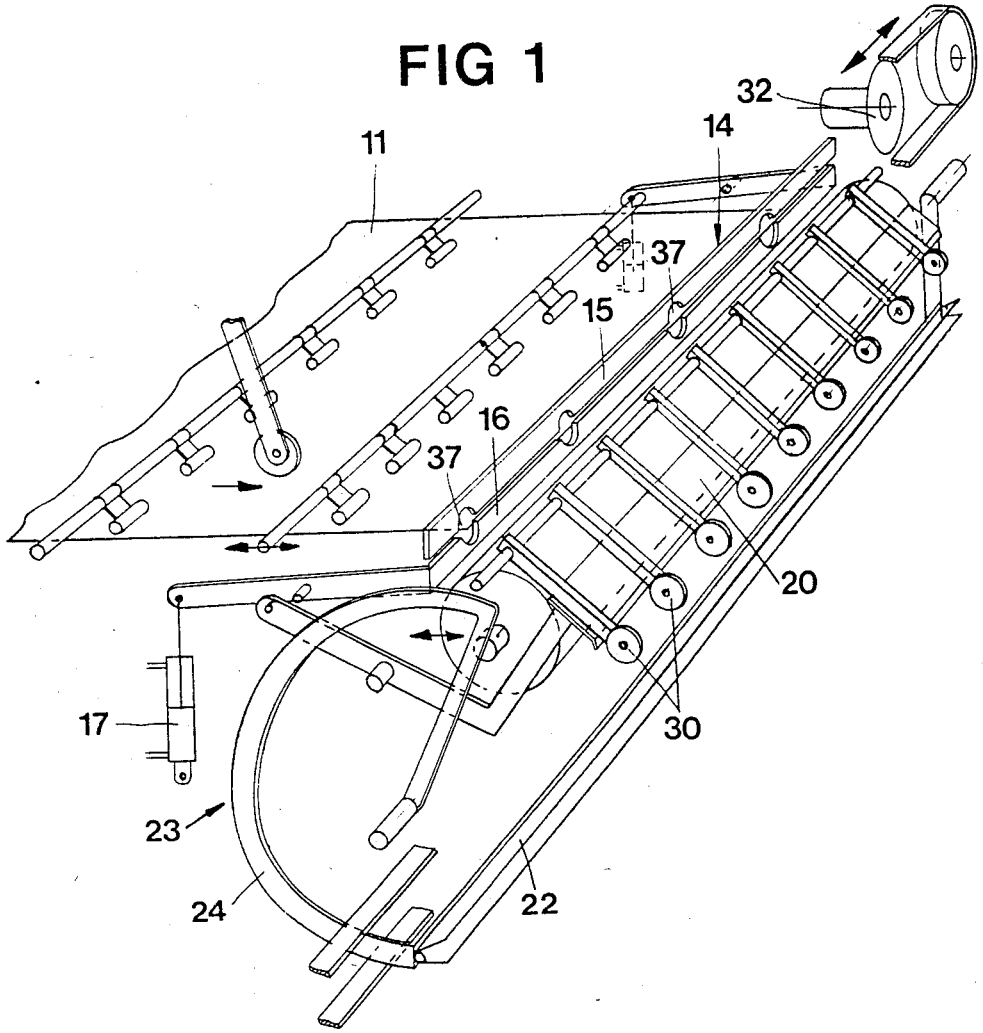
FIG. 1 shows in perspective the device according to the invention in a simplified and schematic embodiment.

A device according the invention consists of a feed table 11 on which a web 12 is fed from a not shown supply roll. The web consists of for example a mesh tissue web provided with pile-free portions 13 which extend laterally across the longitudinal direction of the web. The pile-free portions consist of the bottom fabric of the web. On one end of the feed table 11 there is arranged two straight-edge rulers 14 and 15, one of which is fixed while the other one 15 is movable towards and away from the fixed ruler by means of a suitable driving member 16. The rulers 14, 15 can be adjusted to two positions, one position in which the web can pass freely between the rulers and a second position in which only the pile-free portions of the fabric can pass.

Figure 7:
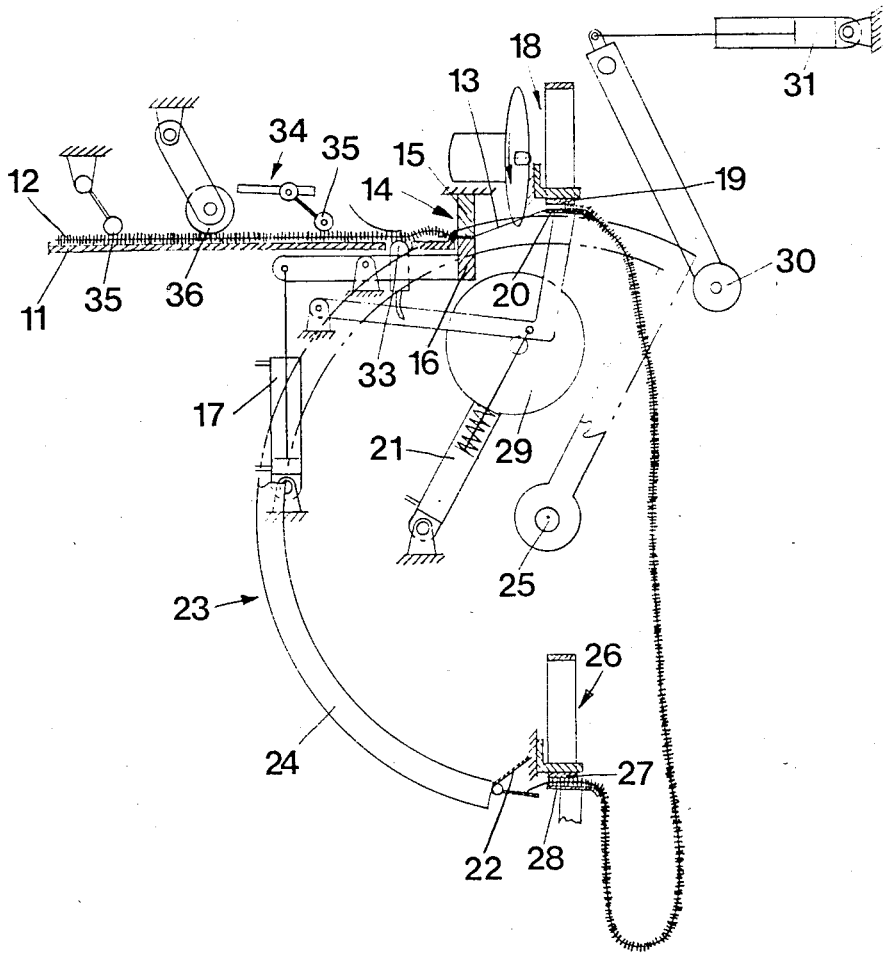
Figure 8:
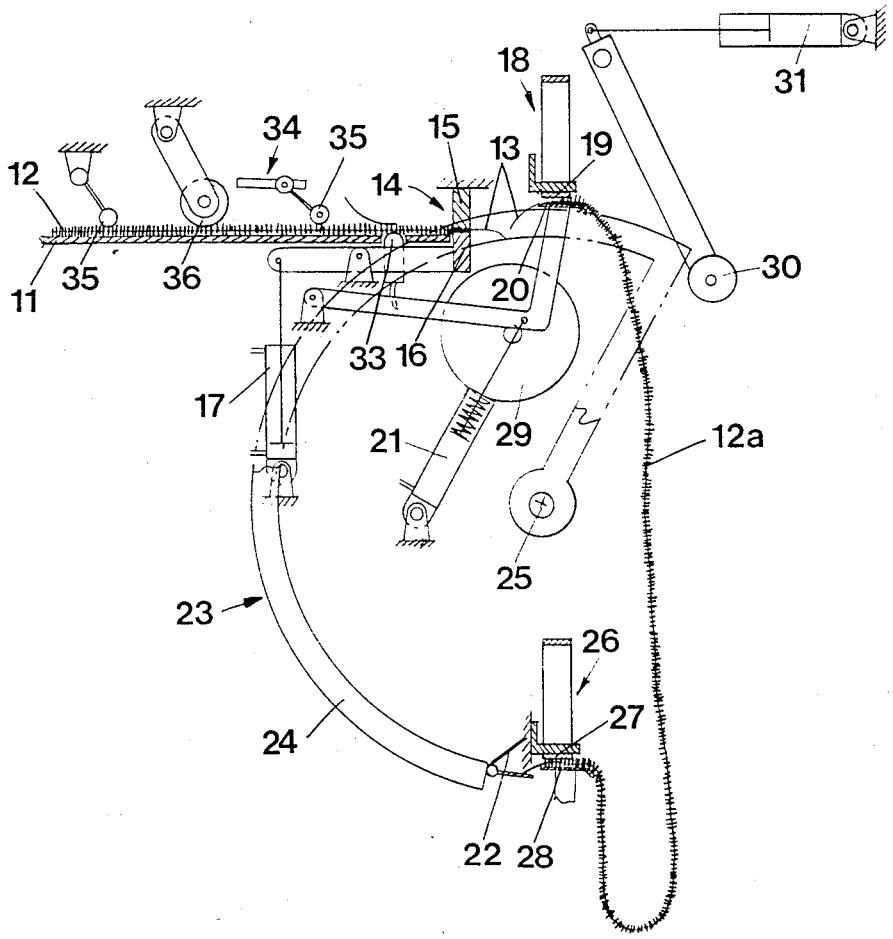

In front of the straightening device 14, as seen in the feed direction of the web and at a distance from this, there is arranged a first conveyor device 18, the lower endless belt part 19 of which is arranged to cooperate with a pressure plate 20, which by means of a suitable driving member 21 is pivotable from a passive position below the web (FIG. 2) to an active position to engagement against the belt part 19 (FIG. 7). With the pressure plate 20 in the passive position a space is formed between this and the belt part 19, through which a seizing means 22 of a transfer device 23 is insertable. The seizing means 22 is attached to an arched handle 24 pivotable about a shaft 25. The arched handle encloses a little more than 180° and is at its bottom crossed by a second conveyor device 26, which like the first conveyor device consists of an endless belt, the lower belt portion 27 of which cooperates with a pivotable pressure plate 28.

Below the straightening device 14 and inside the transfer device 23 there is arranged a rotatable roller 29, which by means of a suitable driving device (not shown) is horizontally displaceable from the passive, retracted position shown in FIG. 2 to the projected active position shown in FIG. 3. The roller 29 cooperates in its active position with one or several press rollers 30 which due to their own weight or with help of an external driving member 31 can be pressed in a direction against the roller 29.

In the space between the straightening device 14 and the first conveyor device 18 there can be inserted a cutting member 32 which runs in not further shown guides arranged thus that the web is cut off a distance from the rulers 15 and 16 of the straightening device 14.

A socket for a sensor 33 is arranged on the feed table 11, which sensor senses the web and gives an impulse when a pile-free portion passes the sensor. At least one, preferably e.g. two locking devices 34, are arranged above the feed table 11, which locking devices consist of one or several rows of elements 35 loosely engaging the web 12, which elements in the feed direction of the web allows the web to pass freely without large friction, while the elements 35 prevents the web from being displaced in the opposite direction. The rear one of the locking devices 34 as seen in the feed direction of the web is provided with driving means (not shown) for horizontal displacement of the elements 35. By displacement of the locking device in a direction towards the straightening device 14 the elements 35 will consequently exert an advancement motion on the web, whereas at the return movement of the reverse locking device the elements 35 can rotate freely about its common shaft without advancing the web. In case there is a desire of measuring the length of the web fed, a conventional cloth measuring member 36 is provided, which with a measuring wheel rests against the web and is driven by this at the advancing of the web.

FUNCTION OF THE INVENTION

Figure 2:
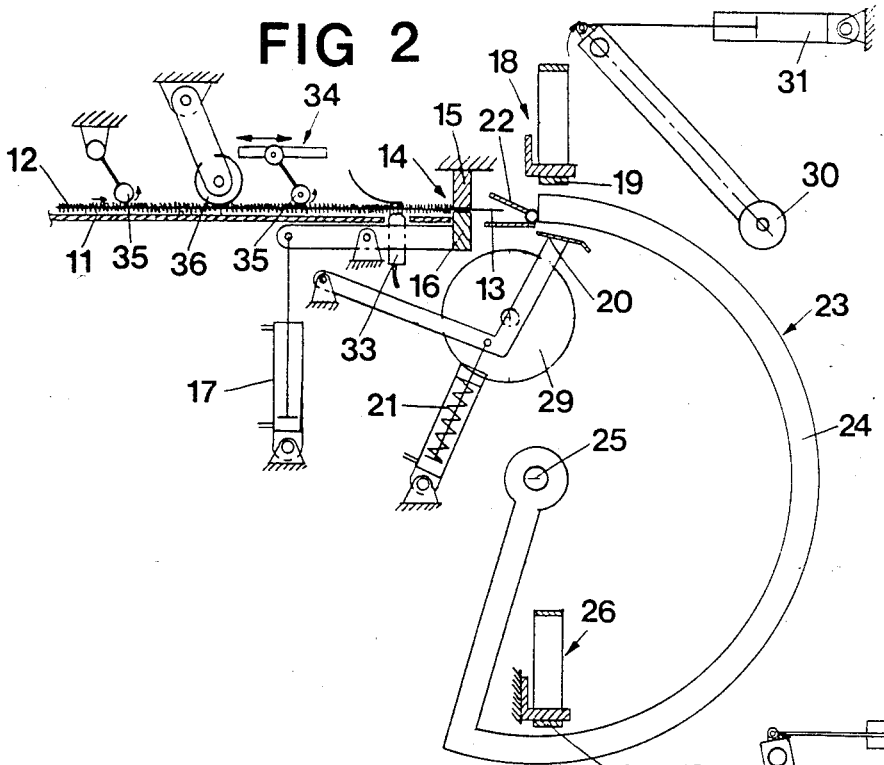
FIGS. 2–8 show the device according to FIG. 1 in side view and in seven different stages of motion.
Figure 3:
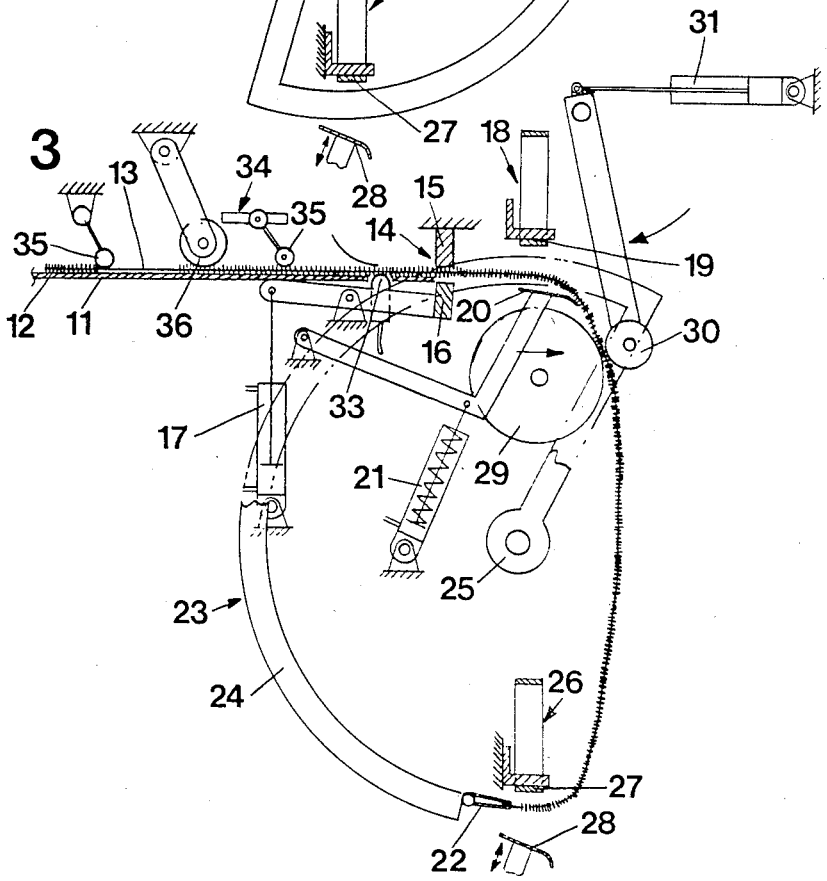
Figure 4:
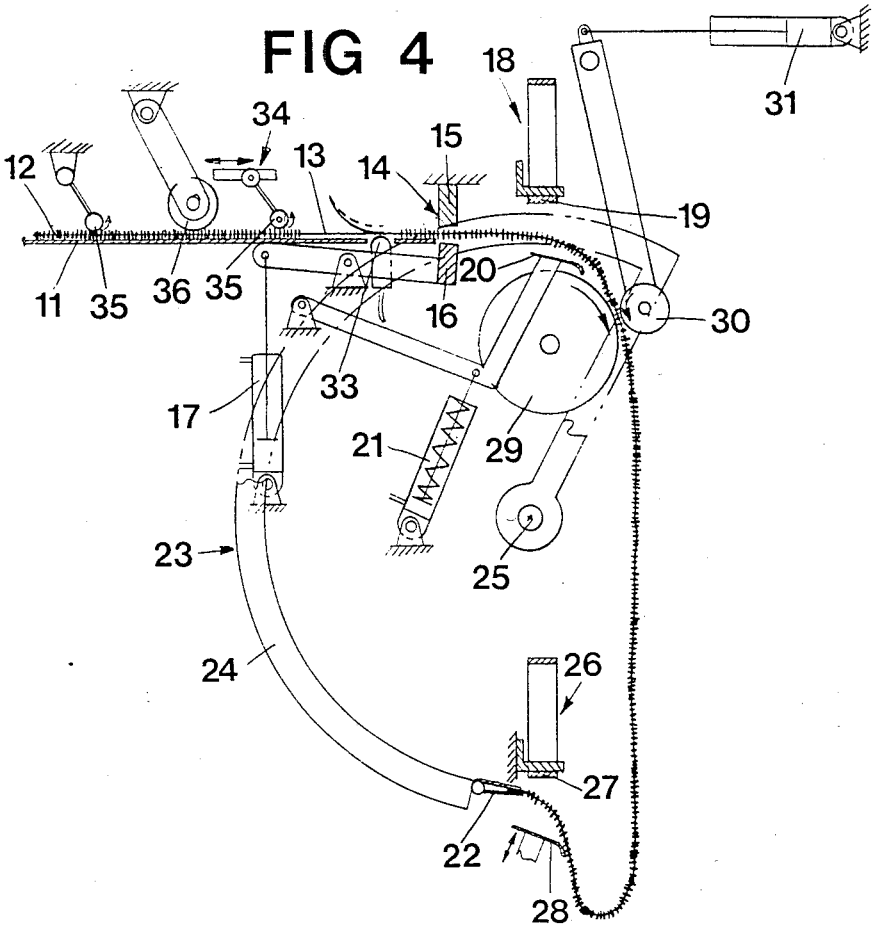
Figure 5:
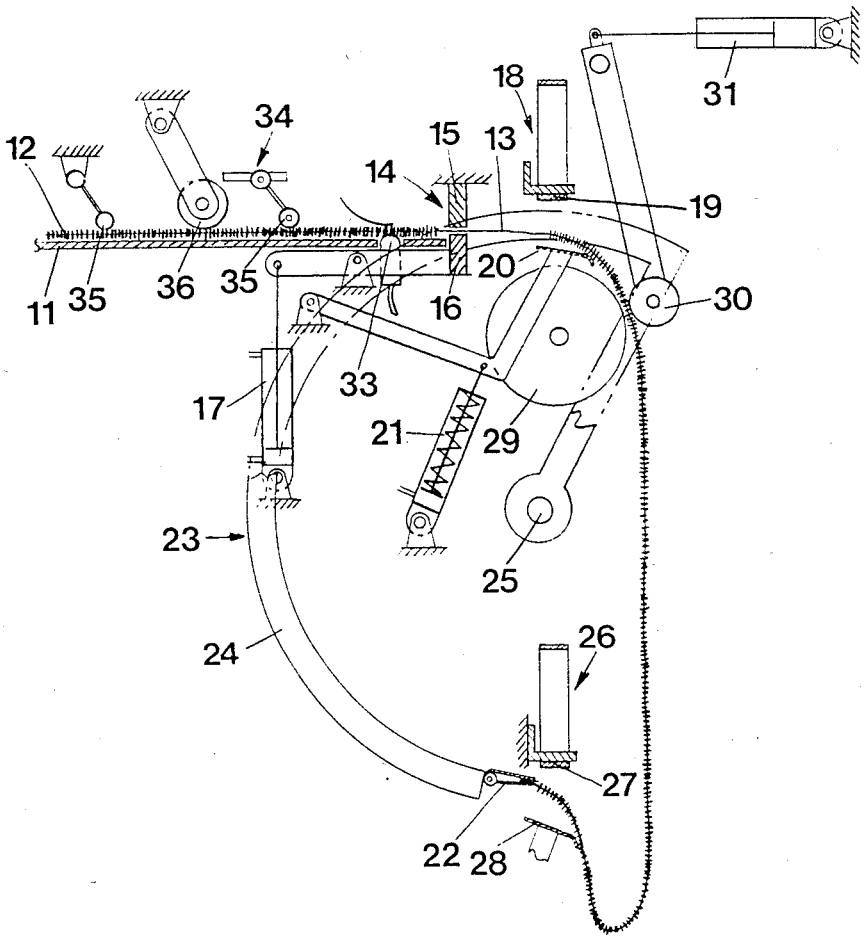
Figure 6:
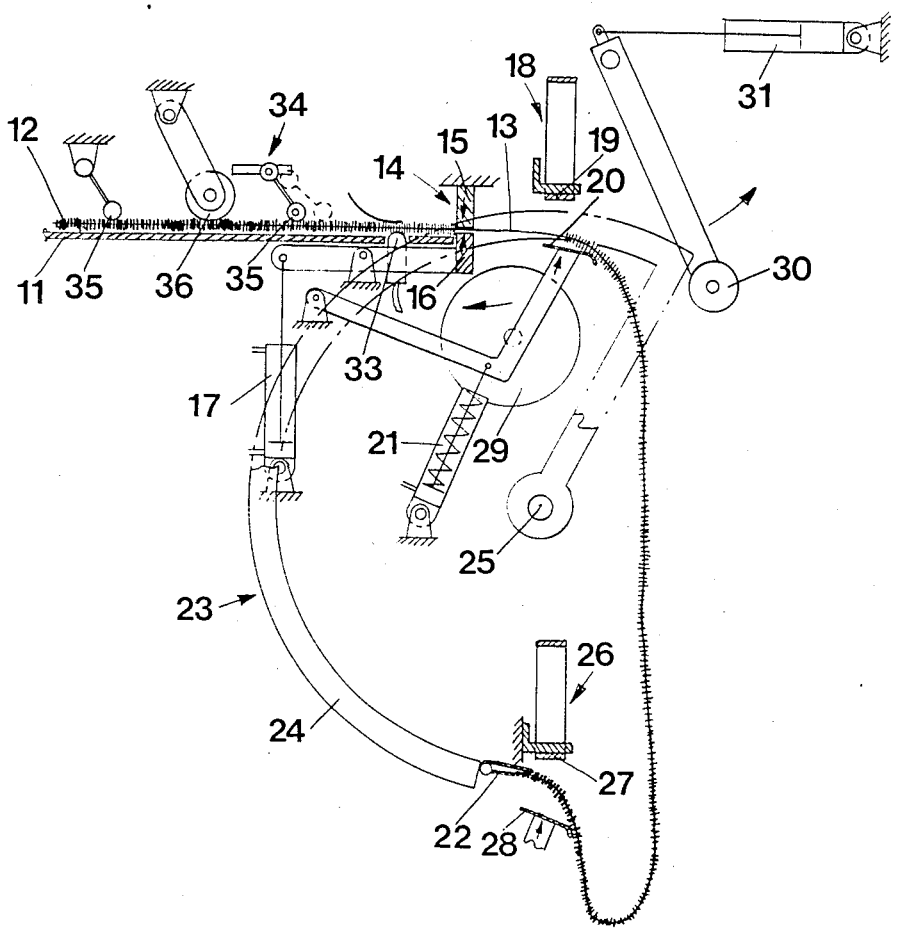

The web 12 is placed in its starting position as shown in FIG. 2 with a pile-free portion 13 located within the operation area of the driving device 22. At start of the device the seizing device 22 will thus seize the free end of the web whereupon the straightening device 14 opens the rulers 15 and 16 and the transfer device 23 can begin its movement of transfer, at which the free end edge of the web will be situated in the space between the belt portion 27 and the pressure plate 28 of the second conveyor device 26 as shown in FIG. 3. The feeding out roller 29 is then displaced towards the engagement rollers 30 and the feeding-out roller 29 is brought to rotate whereby the web situated between the feeding-out roller and the engagement rollers is advanced so much that a pile-free portion 13 will be situated in front of the sensor 33. In this position the straightening device will be activated, whereby the ruler 16 is pivoted towards the fixed ruler 15, so that such a small slot remains, that the bottom fabric of the web, i.e. said pile-free portion 13 can pass through the slot. The feeding-out roller 29 continues to rotate, so that the piled edge of the web will be pulled towards the rulers 15 and 16. In this way a straightening of the web as shown in FIG. 6 takes place. In this straightened position the web 12 will be fixedly located against the lower belt part 19 of the conveyor device 18 by means of the pressure plate 20, which as it appears in FIG. 7 has come to engagement with the belt part 19. At the same time the removable locking device comes into function in its capacity of feeding member by the fact that the device has been displaced some distance against the straightening device 14 and possible traction forces on the portion of the web in front of the straightening device are prevented. The straightening device 14 is thereupon completely closed, so that the web is clamped rigidly between the rulers 15 and 16 and the cutting machine 32 passes over the web and cuts it between the straightening device and the first conveyor in the pile-free portion 13 according to FIG. 7. At the same time the pressure plate 28 has also been activated and pressed to engagement against the lower belt portion 27 of the second conveyor device 26, so that the front end portion of the web is fixed.

With the piece of cloth **12*a* severed from the web 12 the conveyor belts of the conveyor devices 18 and 26 are started, so that both cut edges of the severed piece of cloth 12*a* can be fed perpendicularly to the feed direction of the web 12** to a sewing machine each (not shown) where an edge fixing for example hemming of the transverse edge is effected.

The transfer device 23 thereupon returns to its initial position (FIG. 2) in order to seize a new end edge on the web 12, whereafter the entire procedure is repeated.

By the fact that the end edge of the cut edges of the web or the severed piece of cloth resp. are always in fixed position an exact hemming or other edge trimming of the cut edges can be guaranteed.

The invention is not limited to the embodiment shown but a number of variations are possible within the scope of the claims.

I claim:

1. Apparatus for cutting lengths of cloth from an elongate web, the web having pile sections separated by transverse pile-free bands, the apparatus comprising a table along which the web can be fed longitudinally, a straightening device comprising a pair of rulers extending laterally across the table and being adjustable relative to each other for the selective passage therebetween of only the pile-free bands of the web and of the pile sections, a transfer device and first and second vertically spaced transverse conveyor devices forwardly of the straightening device, the transfer device having seizing means for grabbing a forward edge of the web extending forwardly from the straightening device and transferring same through the first conveyor device to the second conveyor device in a manner advancing a measured length of the web, cutter means for transversely cutting the web forwardly of the straightening means after transfer of the forward edge to the second conveyor device, and arresting means on the first and second conveyor devices for arresting the forward edge and the rearward edge of a cut piece of cloth for transport thereof by the conveyor devices to a trimming device.

2. A device according to claim 1, wherein an advanceable locking device is arranged in front of the straightening device as seen in the feed direction of the web, which locking device acts upon the web and is designed to eliminate tension stresses in the web in front of the straightening device prior to and during the cutting of a piece of cloth.

3. A device according to claim 1, wherein at lest one and preferably both rulers are provided with recesses for hems or the like present along the longitudinal edges of the web.

4. A device according to claim 2, wherein the locking device consists of elements loosely engaging the web, which elements allow free passage of the web in its feed direction and which are arranged to prevent movement of the web in the opposite direction, and that the locking device by means of driving means is displaceable in the longitudinal direction of the web during conveying the web in its feed direction.

5. A device according to claim 1, wherein each arresting means is a pressure plate which can be pressed to engagement against an endless conveyor belt.

* * * * *